US008135324B2

(12) United States Patent
Moorlag

(10) Patent No.: US 8,135,324 B2
(45) Date of Patent: Mar. 13, 2012

(54) FUSER MEMBER AND METHODS OF MAKING THEREOF

(75) Inventor: Carolyn P. Moorlag, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 400 days.

(21) Appl. No.: 12/400,050

(22) Filed: Mar. 9, 2009

(65) Prior Publication Data

US 2010/0226701 A1 Sep. 9, 2010

(51) Int. Cl.
*G03G 15/20* (2006.01)
*G03G 21/00* (2006.01)

(52) U.S. Cl. ..... 399/333; 399/320; 428/447

(58) Field of Classification Search ..... 399/320, 399/324, 330, 331, 333; 428/421, 422, 447
See application file for complete search history.

(56) References Cited

U.S. PATENT DOCUMENTS

| | | | | |
|---|---|---|---|---|
| 4,029,827 | A | 6/1977 | Imperial et al. | |
| 4,101,686 | A | 7/1978 | Strella et al. | |
| 4,185,140 | A | 1/1980 | Strella et al. | |
| 4,257,699 | A | 3/1981 | Lentz | |
| 4,264,181 | A | 4/1981 | Lentz et al. | |
| 4,272,179 | A | 6/1981 | Seanor | |
| 4,515,884 | A | 5/1985 | Field et al. | |
| 4,711,818 | A | 12/1987 | Henry | |
| 5,017,432 | A | 5/1991 | Eddy et al. | |
| 5,061,965 | A | 10/1991 | Ferguson et al. | |
| 5,166,031 | A | 11/1992 | Badesha et al. | |
| 5,281,506 | A | 1/1994 | Badesha et al. | |
| 5,366,772 | A | 11/1994 | Badesha et al. | |
| 5,370,931 | A | 12/1994 | Fratangelo et al. | |
| 5,401,570 | A | 3/1995 | Heeks et al. | |
| 5,409,557 | A | 4/1995 | Mammino et al. | |
| 5,487,707 | A | 1/1996 | Sharf et al. | |
| 5,512,409 | A | 4/1996 | Henry et al. | |
| 5,514,436 | A | 5/1996 | Schlueter, Jr. et al. | |
| 5,516,361 | A | 5/1996 | Chow et al. | |
| 5,698,320 | A | 12/1997 | Ebisu et al. | |
| 5,716,747 | A | 2/1998 | Uneme et al. | |
| 5,991,590 | A | 11/1999 | Chang et al. | |
| 6,099,673 | A | 8/2000 | Van Bennekom | |
| 6,253,055 | B1 | 6/2001 | Badesha et al. | |
| 6,408,753 | B1 | 6/2002 | Finn et al. | |
| 6,410,149 | B1 * | 6/2002 | Hendricks et al. | 428/447 |
| 6,871,040 | B2 * | 3/2005 | Tani et al. | 399/329 |
| 7,214,423 | B2 | 5/2007 | Finn et al. | |
| 7,242,900 | B2 | 7/2007 | Blair et al. | |
| 7,462,395 | B2 | 12/2008 | Longhenry et al. | |
| 2004/0002012 | A1 * | 1/2004 | Pavlisko et al. | 430/45 |
| 2007/0037903 | A1 | 2/2007 | Swift | |

FOREIGN PATENT DOCUMENTS

JP 2008145832 A * 6/2008

* cited by examiner

*Primary Examiner* — David Gray
*Assistant Examiner* — Fred L Braun
(74) *Attorney, Agent, or Firm* — MH2 Technology Law Group LLP

(57) ABSTRACT

A fuser member includes a substrate and an outer layer including a polymeric material and an aerogel component including aerogel particles having a surface area of from about 400 to about 1200 m2/g that is at least one of dispersed in or bonded to the polymeric material. Methods of making a fuser member include applying an outer layer including a polymeric material and an aerogel component over a substrate, and curing the outer layer such that the aerogel component is at least one of dispersed in or bonded to the polymeric material.

19 Claims, 1 Drawing Sheet

FUSER MEMBER AND METHODS OF MAKING THEREOF

TECHNICAL FIELD

This disclosure is generally directed to fuser members useful in electrophotographic reproducing apparatuses, including digital, image on image, and contact electrostatic printing apparatuses. The present fuser members can be used as fuser members, pressure members, transfuse or transfix members, and the like. In an embodiment, the fuser members comprise an outer layer comprising a polymeric material and an aerogel component. This disclosure also relates to processes for making and using the imaging members.

RELATED APPLICATIONS

U.S. Pat. No. 7,242,900 discloses a fuser member comprising: a substrate; and an outer layer comprising a polymeric material; wherein said polymeric material is post-halogenated to provide a post-halogenated polymeric material.

U.S. Pat. No. 7,462,395 discloses a fuser member comprising: a substrate; and an outer layer comprising a polymeric material and a methacrylate-based fluorosurfactant.

Copending U.S. patent application Ser. No. 11/201,082 filed Aug. 11, 2005, discloses a nanocomposite composition comprising: one or more aerogel components, and one or more polymeric resin components; wherein the nanocomposite composition is capable of absorbing water in an amount that is less than an amount that can be absorbed by the polymeric resin components. The nanocomposite composition is useful, for example, in imaging members.

The appropriate components and process aspects of the foregoing, such as the fuser member composition, components and methods, may be selected for the present disclosure in embodiments thereof. The entire disclosures of the above-mentioned application is totally incorporated herein by reference.

REFERENCES

U.S. Pat. No. 4,257,699 to Lentz, discloses a fuser member comprising at least one outer layer of an elastomer containing a metal-containing filler and use of a polymeric release agent.

U.S. Pat. No. 4,264,181 to Lentz et al., discloses a fuser member having an elastomer surface layer containing metal-containing filler therein and use of a polymeric release agent.

U.S. Pat. No. 4,272,179 to Seanor, discloses a fuser member having an elastomer surface with a metal-containing filler therein and use of a mercapto-functional polyorganosiloxane release agent.

U.S. Pat. No. 5,401,570 to Heeks et al., discloses a fuser member comprised of a substrate and thereover a silicone rubber surface layer containing a filler component, wherein the filler component is reacted with a silicone hydride release oil.

U.S. Pat. No. 4,515,884 to Field et al., discloses a fuser member having a silicone elastomer-fusing surface, which is coated with a toner release agent, which includes an unblended polydimethyl siloxane.

U.S. Pat. No. 5,512,409 to Henry et al. teaches a method of fusing thermoplastic resin toner images to a substrate using amino functional silicone oil over a hydrofluoroelastomer fuser member.

U.S. Pat. No. 5,516,361 to Chow et al. teaches a fusing member having a thermally stable FKM hydrofluoroelastomer surface and having a polyorgano T-type amino functional oil release agent. The oil has predominantly monoamino functionality per active molecule to interact with the hydrofluoroelastomer surface.

U.S. Pat. No. 6,253,055 to Badesha et al. discloses a fuser member coated with a hydride release oil.

U.S. Pat. No. 5,991,590 to Chang et al. discloses a fuser member having a low surface energy release agent outermost layer.

U.S. Pat. No. 7,214,423 to Finn et al. discloses a coated printing machine component comprising a substrate and a cured wear resistant fluoroelastomeric coating composition comprising a fluoroelastomer, filler selected from SiC and AlN, and a coupling agent, where the coupling agent is selected from the group consisting of zirconates and aluminates and wherein the component is selected from the group consisting of fuser elements, transfix members, rheological transfer members, and ink conditioners and receivers.

The use of polymeric release agents having functional groups, which interact with a fuser member to form a thermally stable, renewable self-cleaning layer having good release properties for electroscopic thermoplastic resin toners, is described in U.S. Pat. Nos. 4,029,827; 4,101,686; and 4,185,140. Disclosed in U.S. Pat. No. 4,029,827 is the use of polyorganosiloxanes having mercapto functionality as release agents. U.S. Pat. Nos. 4,101,686 and 4,185,140 are directed to polymeric release agents having functional groups such as carboxy, hydroxy, epoxy, amino, isocyanate, thioether and mercapto groups as release fluids. U.S. Pat. No. 5,716,747 discloses the use of fluorine-containing silicone oils for use on fixing rollers with outermost layers of ethylene tetrafluoride perfluoro alkoxyethylene copolymer, polytetrafluoroethylene and polyfluoroethylenepropylene copolymer. U.S. Pat. No. 5,698,320 discloses the use of fluorosilicone polymers for use on fixing rollers with outermost layers of perfluoroalkoxy and tetrafluoroethylene resins.

Aerogel compositions have been proposed for use as fillers in contact charge rolls and transfer belts in electrographic reproducing apparatuses. For example, U.S. Pat. No. 4,711,818 discloses a thermally conductive dry release fuser member and fusing method for use in electrostatic reproducing machine without the application of a release agent is described, wherein the fusing member comprises a base support member and a thin deformable layer of a composition coated thereon, the composition comprising the crosslinked product of a mixture of at least one addition curable vinyl terminated or vinyl pendant polyfluoroorganosiloxane, filler, heat stabilizer, a crosslinking agent and a crosslinking catalyst. The filler can include a silica aerogel that is crosslinked to the polyfluoroorganosiloxane.

The disclosures of each of the foregoing patents are hereby incorporated by reference herein in their entireties. The appropriate components and process aspects of the each of the foregoing patents may also be selected for the present compositions and processes in embodiments thereof.

BACKGROUND

In a typical electrostatographic reproducing apparatus, a light image of an original to be copied is recorded in the form of an electrostatic latent image upon a photosensitive member, and the latent image is subsequently rendered visible by the application of electroscopic thermoplastic resin particles and pigment particles, or toner. The visible toner image is then in a loose powdered form and can be easily disturbed or destroyed. The toner image is usually fixed or fused upon a support, which may be the photosensitive member itself, or other support sheet such as plain paper.

The use of thermal energy for fixing toner images onto a support member is well known. To fuse electroscopic toner material onto a support surface permanently by heat, it is usually necessary to elevate the temperature of the toner material to a point at which the constituents of the toner material coalesce and become tacky. This heating causes the toner to flow to some extent into the fibers or pores of the support member. Thereafter, as the toner material cools, solidification of the toner material causes the toner material to be firmly bonded to the support.

Typically, the thermoplastic resin particles are fused to the substrate by heating to a temperature of between about 90° C. to about 200° C. or higher depending upon the softening range of the particular resin used in the toner. It may be undesirable; however, to increase the temperature of the substrate substantially higher than about 250° C. because of the tendency of the substrate to discolor or convert into fire at such elevated temperatures, particularly when the substrate is paper.

Several approaches to thermal fusing of electroscopic toner images have been described. These methods include providing the application of heat and pressure substantially concurrently by various means, a roll pair maintained in pressure contact, a belt member in pressure contact with a roll, a belt member in pressure contact with a heater, and the like. Heat may be applied by heating one or both of the rolls, plate members, or belt members. The fusing of the toner particles takes place when the proper combinations of heat, pressure and contact time are provided. The balancing of these parameters to bring about the fusing of the toner particles is well known in the art, and can be adjusted to suit particular machines or process conditions.

During operation of a fusing system in which heat is applied to cause thermal fusing of the toner particles onto a support, both the toner image and the support are passed through a nip formed between the roll pair, or plate or belt members. The concurrent transfer of heat and the application of pressure in the nip affect the fusing of the toner image onto the support. It is important in the fusing process that no offset of the toner particles from the support to the fuser member takes place during normal operations. Toner particles offset onto the fuser member may subsequently transfer to other parts of the machine or onto the support in subsequent copying cycles, thus increasing the background or interfering with the material being copied there. The referred to "hot offset" occurs when the temperature of the toner is increased to a point where the toner particles liquefy and a splitting of the molten toner takes place during the fusing operation with a portion remaining on the fuser member. The hot offset temperature or degradation of the hot offset temperature is a measure of the release property of the fuser roll, and accordingly it is desired to provide a fusing surface, which has a low surface energy to provide the necessary release. To ensure and maintain good release properties of the fuser roll, it has become customary to apply release agents to the fuser roll during the fusing operation. Typically, these materials are applied as thin films of, for example, nonfunctional silicone oils or mercapto- or amino-functional silicone oils, to prevent toner offset.

SUMMARY

In producing fuser and related members, the members are made by applying sequential layers to a substrate, and allowing or causing the layers to dry. For example, fuser roll members can be made by applying a topcoat material to a substrate, where the topcoat material can be a low surface-energy fluoropolymers, such as VITON® fluoropolymer. These materials have provided heat- and wear-resistance, conformability, and release at the fusing nip. However, in order to improve machine usage, current fuser rolls would benefit from improvement in mechanical properties to prevent edge-wear and other defects. Roll contamination is also an issue, and is currently mitigated with the use of a release oil, such as PDMS-based fusing oil. Accordingly, new topcoat materials are desired that provide improved wear resistance and/or release. It has been found that aerogel components, such as aerogel ceramic fillers, which are porous, robust particles, provide mechanical improvement to the fluoropolymer topcoat, while the hydrophobic properties of the aerogel decreases surface energy, which can improve release and/or lower the required amount of fuser oil.

This disclosure in embodiments relates to a fuser member comprising:

a substrate; and an outer layer comprising a polymeric material and an aerogel component that is at least one of dispersed in or bonded to the polymeric material.

In other embodiments, the disclosure relates to a method of making a fuser member, comprising:

applying an outer layer comprising a polymeric material and an aerogel component that is at least one of dispersed in or bonded to the polymeric material over a substrate.

In another embodiment, the disclosure provides an image forming apparatus for forming images on a recording medium comprising:

a charge-retentive surface to receive an electrostatic latent image thereon;

a development component to apply a developer material to the charge-retentive surface to develop the electrostatic latent image to form a developed image on the charge retentive surface;

a transfer component to transfer the developed image from the charge retentive surface to a copy substrate; and a fuser member component to fuse the transferred developed image to the copy substrate, wherein the fuser member comprises:

a substrate; and an outer layer comprising a polymeric material and an aerogel component that is at least one of dispersed in or bonded to the polymeric material,

BRIEF DESCRIPTION OF THE DRAWINGS

These and other advantages and features of this disclosure will be apparent from the following, especially when considered with the accompanying drawings, in which.

EMBODIMENTS

The fuser member has an outer layer comprising an aerogel component that is at least one of dispersed in or bonded to a polymeric material. The aerogel component is generally, in embodiments, a porous, micron-sized, aerogel ceramic filler, which can be chemically or otherwise treated to be hydrophobic. It has been found that the robust nature of such ceramic particles can provide an improvement in mechanical properties to a fuser member, such as improved toughness and tensile strain, in order to reduce edgewear typically seen in some fuser rolls. The hydrophobic nature of the aerogels, such as silicon oxide-based microparticles, can also aid in low surface energy at the surface of the fuser member, providing improved toner release. Both of these unexpected improvements provided by the present disclosure are in direct contrast to other conventional hard filler particles, such as carbon black or metal oxides, that often increase surface free energy and act as points of interaction for contamination. A further unexpected benefit of the aerogel components is that the aerogel powder can provide better interaction with fusing oils, such as PDMS-based fusing oil, which may lead to additional benefits such as further improved release, decreased use of fuser oil, and the like. For example, the hydrophobic aerogels can act as an oil absorber, leading to absorption of some fusing oil into the fusing topcoat. Fuser oil absorbed into the surface could mitigate contamination and enable a low-oil fusing approach to reduce end-use application issues.

Figure 1:
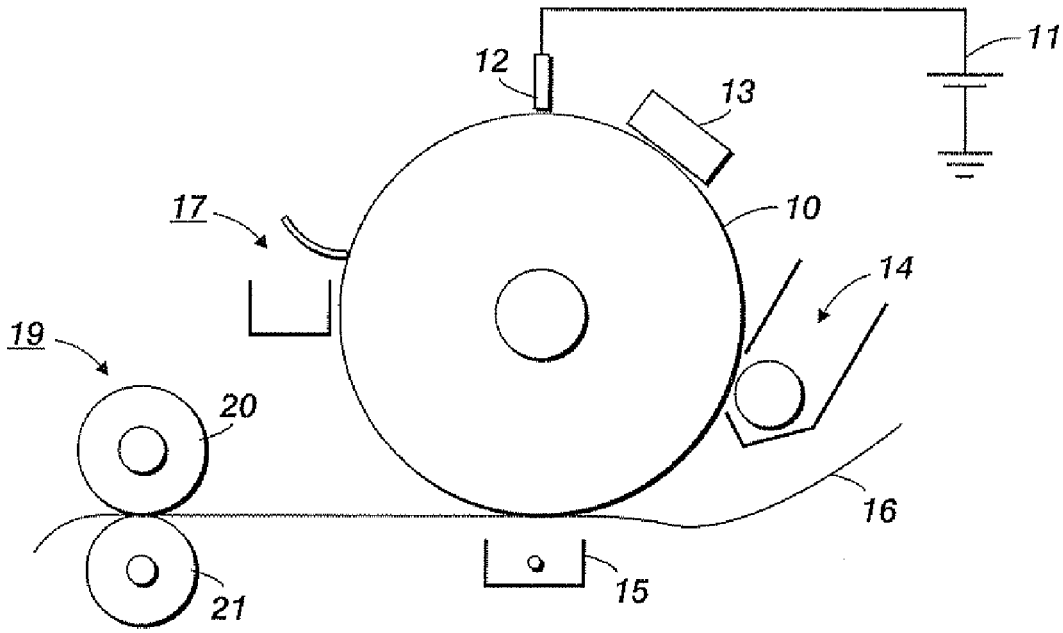
FIG. 1 is a schematic illustration of an image apparatus in accordance with the present disclosure.

Referring to FIG. 1, in a typical electrostatographic reproducing apparatus, a light image of all original to be copied is recorded in the form of an electrostatic latent image upon a photosensitive member and the latent image is subsequently rendered visible by the application of electroscopic thermoplastic resin particles which are commonly referred to as toner. Specifically, photoreceptor 10 is charged on its surface by means of a charger 12 to which a voltage has been supplied from power supply 11. The photoreceptor is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process. A dry developer mixture usually comprises carrier granules having toner particles adhering triboelectrically thereto. Toner particles are attracted from the carrier granules to the latent image forming a toner powder image thereon. Alternatively, a liquid developer material may be employed, which includes a liquid carrier having toner particles dispersed therein. The liquid developer material is advanced into contact with the electrostatic latent image and the toner particles are deposited thereon in image configuration.

After the toner particles have been deposited on the photoconductive surface, in image configuration, they are transferred to a copy sheet 16 by transfer means 15, which can be pressure transfer or electrostatic transfer. Alternatively, the developed image can be transferred to an intermediate transfer member, or bias transfer member, and subsequently transferred to a copy sheet. Examples of copy substrates include paper, transparency material such as polyester, polycarbonate, or the like, cloth, wood, or any other desired material upon which the finished image will be situated.

After the transfer of the developed image is completed, copy sheet 16 advances to fusing station 19, depicted in FIG. 1 as fuser roll 20 and pressure roll 21 (although any other fusing components such as fuser belt in contact with a pressure roll, fuser roll in contact with pressure belt, and the like, are suitable for use with the present apparatus), wherein the developed image is fused to copy sheet 16 by passing copy sheet 16 between the fusing and pressure members, thereby forming a permanent image. Alternatively, transfer and fusing can be effected by a transfix application. The fuser component can be a fuser member as described herein.

Photoreceptor 10, subsequent to transfer, advances to cleaning station 17, wherein any toner left on photoreceptor 10 is cleaned therefrom by use of a blade (as shown in FIG. 1), brush, or other cleaning apparatus.

Figure 2:
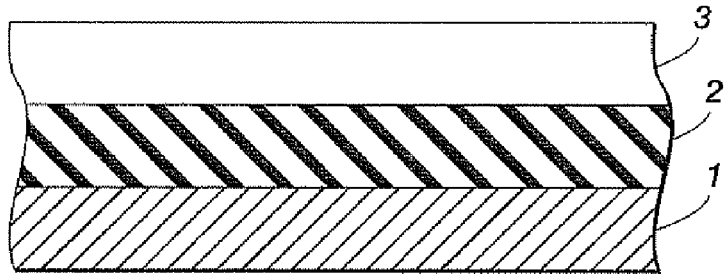
FIG. 2 is an enlarged, side view of an embodiment of a fuser member, showing a fuser member with a substrate, intermediate layer, and outer layer.

FIG. 2 is an enlarged schematic view of an embodiment of a fuser member, demonstrating the various possible layers. As shown in FIG. 2, substrate 1 has intermediate layer 2 thereon. Intermediate layer 2 can be, for example, a rubber such as silicone rubber or other suitable rubber material. On intermediate layer 2 is positioned outer layer 3 comprising a polymer as described below.

The term "fuser member" as used herein refers to fuser members including fusing rolls, belts, films, sheets, and the like; donor members, including donor rolls, belts, films, sheets, and the like; and pressure members, including pressure rolls, belts, films, sheets, and the like; and other members useful in the fusing system of an electrostatographic or xerographic, including digital, machine. The fuser member of the present disclosure can be employed in a wide variety of machines, and is not specifically limited in its application to the particular embodiment depicted herein.

The outer layer of the fuser member can be formed of any suitable polymeric material, including, but not limited to, polyolefins, fluorinated hydrocarbons (fluorocarbons), and engineered resins. The outer layer can comprise homopolymers, copolymers, higher order polymers, or mixtures thereof, and can comprise one species of polymeric material or mixtures of multiple species of polymeric material, such as mixtures of two, three, four, five or more multiple species of polymeric material. In embodiments, the outer layer is formed of a fluoroelastomer.

Specifically, suitable fluoroelastomers are those described in detail in U.S. Pat. Nos. 5,166,031, 5,281,506, 5,366,772, 5,370,931, 4,257,699, 5,017,432 and 5,061,965, the disclosures each of which are incorporated by reference herein in their entirety. As described therein, these elastomers are from the class of 1) copolymers of vinylidenefluoride and hexafluoropropylene; 2) terpolymers of vinylidenefluoride, hexafluoropropylene and tetrafluoroethylene; and 3) tetrapolymers of vinylidenefluoride, hexafluoropropylene, tetrafluoroethylene and cure site monomer, are known commercially under various designations as VITON A®, VITON B®, VITON E®, VITON E60C®, VITON E430®, VITON 910®, VITON GH®; VITON GF®; Viton GF-S; and VITON ETP®. The VITON® designation is a Trademark of E.I. DuPont de Nemours, Inc. The cure site monomer can be 4-bromoperfluorobutene-1,1,1-dihydro-4-bromoperfluorobutene-1,3-bromoperfluoropropene-1,1,1-dihydro-3-bromoperfluoropropene-1, or any other suitable, known cure site monomer commercially available from DuPont. Other commercially available fluoropolymers include FLUOREL 2170®, FLUOREL 2174®, FLUOREL 2176®, FLUOREL 2177® and FLUOREL LVS 76®, FLUOREL® being a Trademark of 3M Company. Additional commercially available materials include AFLAS™ a polypropylene-tetrafluoroethylene) and FLUOREL II® (LII900) a poly(propylene-tetrafluoroethylenevinylidenefluoride) both also available from 3M Company, as well as the Tecnoflons identified as FOR-60KIRO, FOR-LHF®, NM® FOR-THF®, FOR-TFS®, TH®, and TN505®, available from Montedison Specialty Chemical Company.

Examples of fluoroelastomers useful for the surfaces of fuser members include fluoroelastomers, such as fluoroelastomers of vinylidenefluoride-based fluoroelastomers, hexafluoropropylene and tetrafluoroethylene as comonomers. There are also copolymers of one of vinylidenefluoride, hexafluoropropylene and tetrafluoroethylene. Examples of three known fluoroelastomers are (1) a class of copolymers of two of vinylidenefluoride, hexafluoropropylene and tetrafluoroethylene, such as those known commercially as VITON A® (2) a class of terpolymers of vinylidenefluoride, hexafluoropropylene and tetrafluoroethylene known commercially as VITON B® and (3) a class of tetrapolymers of vinylidenefluoride, hexafluoropropylene, tetrafluoroethylene and cure site monomer known commercially as VITON GH® or VITON GF®.

The fluoroelastomers VITON GH® and VITON GF® have relatively low amounts of vinylidenefluoride. The VITON GF® and Viton GH® have about 35 weight percent of vinylidenefluoride, about 34 weight percent of hexafluoropropylene and about 29 weight percent of tetrafluoroethylene with about 2 weight percent cure site monomer.

The amount of fluoroelastomer compound in solution in the outer layer solutions, in weight percent total solids, is from about 10 to about 25 percent, or from about 16 to about 22 percent by weight of total solids. Total solids as used herein include the amount of fluoroelastomer, dehydrofluorinating agent and optional adjuvants and fillers, including aerogel components.

In addition to the fluoroelastomer, the outer layer may comprise a fluoropolymer or other fluoroelastomer blended with the above fluoroelastomer. Examples of suitable polymer blends include the above fluoroelastomer, blended with a fluoropolymer selected from the group consisting of polytetrafluoroethylene and perfluoroalkoxy. The fluoroelastomer can also be blended with non-fluorinated ethylene or non-fluorinated propylene.

The fuser member outer layer coating solution also contains an aerogel component. The aerogel component is blended with the polymeric material, such that in the dried layer the aerogel is that is at least one of dispersed in or bonded to the polymeric material. That is, in one embodiment, the aerogel can be simply mixed or dispersed in the polymeric material, but is not chemically bonded to (such as being crosslinked with) the polymer material. In another embodiment, the aerogel can be chemically bonded to the polymer material, such as being crosslinked with the polymer material. In still another embodiment, the aerogel can be have some particles that are simply mixed or dispersed in the polymeric material, while other particles are chemically bonded to the polymer material, such as being crosslinked with the polymer material. As used herein, the aerogel material being "bonded" to the polymer matrix refers to chemical bonding such as ionic or covalent bonding, and not to such weaker bonding mechanisms such as hydrogen bonding or physical entrapment of molecules that may occur when two chemical species are in close proximity to each other.

Thus, for example, aerogel particles could be bonded into the matrix, or not, depending on the type of crosslinker used. For example, the crosslinker AO700 (N-(2-aminoethyl)-3-aminopropyltrimethoxysilane, available from United Chemical Technologies, Inc.), used in the Example below, has siloxane linkages and could potentially crosslink aerogel particles, particularly silica aerogel, if used. As another example, bisphenol-A crosslinker could be used to bind carbon aerogel. Thus, although crosslinker is added primarily for the purpose of crosslinking fluoropolymer chains together, it can also be added in an amount or type sufficient to also bind aerogel particles into or onto the polymer matrix. In comparison to the present invention, which uses fluoropolymers that are crosslinked with crosslinker, with aerogel added to modify properties, U.S. Pat. No. 4,711,818 uses different liquid perfluoroorgano siloxane monomers and forms a different bulk siloxane/fluorinated chain network, without requiring the same types of crosslinkers and using crosslinker catalysts. The aerogel particles thus modify different materials in different ways.

Any suitable aerogel component can be used. In embodiments, the aerogel component can be, for example, selected from inorganic aerogels, organic aerogels, carbon aerogels, and mixtures thereof. In particular embodiments, ceramic aerogels can be suitably used. These aerogels are typically composed of silica, but may also be composed of metal oxides, such as aluminum oxide, or carbon, and can optionally be doped with other elements such as a metal. In some embodiments, the aerogel component can comprise aerogels chosen from polymeric aerogels, colloidal aerogels, and mixtures thereof.

Aerogels may be described, in general terms, as gels that have been dried to a solid phase by removing pore fluid. As used herein, an "aerogel" refers to a material that is generally a very low density ceramic solid, typically formed from a gel. The term "aerogel" is thus used to indicate gels that have been dried so that the gel shrinks little during drying, preserving its porosity and related characteristics. In contrast, "hydrogel" is used to describe wet gels in which pore fluids are aqueous fluids. The term "pore fluid" describes fluid contained within pore structures during formation of the pore element(s). Upon drying, such as by supercritical drying, aerogel particles are formed that contain a significant amount of air, resulting in a low density solid and a high surface area. In various embodiments, aerogels are thus low-density microcellular materials characterized by low mass densities, large specific surface areas and very high porosities. In particular, aerogels are characterized by their unique structures that comprise a large number of small inter-connected pores. After the solvent is removed, the polymerized material is pyrolyzed in an inert atmosphere to form the aerogel.

The aerogel component can be either formed initially as the desired sized particles, or can be formed as larger particles and then reduced in size to the desired size. For example, formed aerogel materials can be ground, or they can be directly formed as nano to micron sized aerogel particles.

Aerogel components of embodiments may have porosities of from about 10% to at least about 50%, or more than about 90% to about 99.9%, in which the aerogel can contain 99.9% empty space. For example, the aerogel may suitably have a porosity of from about 50 to about 90% or more, such as from about 55 to about 99%. In embodiments, the pores of aerogel components may have diameters of less than about 500 nm or less than about 50 nm in size. For example, the average pore diameter of the aerogel maybe from about 10 or less to about 100 nm. In particular embodiments, aerogel components may have porosities of more than 50% pores with diameters of less than 100 nm and even less than about 20 nm. In embodiments, the aerogel components may be in the form of particles having a shape that is spherical, or near-spherical, cylindrical, rod-like, bead-like, cubic, platelet-like, and the like.

In embodiments, the aerogel components include aerogel particles, powders, or dispersions ranging in average volume particle size of from the sub-micron range to about 50 micons or more. For example, in embodiments, the aerogel component can have an average volume particle size of from about 50 nm to about 50 μm, such as about 100 nm or about 500 nm to about 20 μm or about 30 μm. In one particular embodiment, the aerogel component can have an average volume particle size of from about 1 μm to about 15 μm, such as about 1 μm or about 2 μm to about 10 μm or about 15 μm, such as about 5 μm. The aerogel components can include aerogel particles that appear as well dispersed single particles or as agglomerates of more than one particle or groups of particles within the polymer material.

Generally, the type, porosity, pore size, and amount of aerogel used for a particular embodiment may be chosen based upon the desired properties of the resultant composition and upon the properties of the polymers and solutions thereof into which the aerogel is being combined. For example, if a pre-polymer (such as a low molecular weight polyurethane monomer that has a relatively low process viscosity, for example less than 10 centistokes) is chosen for use in an embodiment, then a high porosity, for example greater than 80%, and high specific surface area, for example > about 500 $m^2$/gm, aerogel having relatively small pore size, for example less than about 50 to about 100 nm, may be mixed at relatively high concentrations, for example greater than about 2 to about 20% by weight, into the pre-polymer by use of moderate-to-high energy mixing techniques, for example by controlled temperature, high shear, blending. If a hydrophilic-type aerogel is used, upon cross-linking and curing/post curing the pre-polymer to form an infinitely long matrix of polymer and aerogel filler, the resultant composite may exhibit improved hydrophobicity and increased hardness when compared to a similarly prepared sample of unfilled polymer. The improved hydrophobicity may be derived from the polymer and aerogel interacting during the liquid-phase processing whereby a portion of the molecular chain of the polymer interpenetrates into the pores of the aerogel and the non-pore regions of the aerogel serves to occupy some or all of the intermolecular space that where water molecules could otherwise enter and occupy.

The continuous and monolithic structure of interconnecting pores that characterizes aerogel components also leads to high surface areas and, depending upon the material used to comprise the aerogel, the electrical conductivity may range from highly thermally and electrically conducting to highly thermally and electrically insulating. Further, aerogel components in embodiments may have surface areas ranging from about 400 to about 1200 $m^2$/g, such as from about 500 to about 1200 $m^2$/g, or from about 700 to about 900 $m^2$/g. In embodiments, aerogel components may have electrical resistivities greater than about $1.0\times10^{-4}$ Ω-cm, such as in a range of from about 0.01 to about $1.0\times10^{16}$ Ω-cm, from about 1 to about $1.0\times10^{8}$ Ω-cm, or from about 50 to about 750,000 Ω-cm. Different types of aerogels used in various embodiments may also have electrical resistivities that span from conductive, about 0.01 to about 1.00 Ω-cm, to insulating, more than about $10^{16}$ Ω-cm. Conductive aerogels of embodiments, such as carbon aerogels, may be combined with other conductive fillers to produce combinations of physical, mechanical, and electrical properties that are otherwise difficult to obtain. For example, a combination of carbon aerogel and carbon fiber may be added to a suitable polymer, such as a solution of polyphenylene sulfide (PPS), and then dried to yield a solid composite that may have a relatively high modulus, a very low coefficient of humidity expansion, a low resistivity, and stable dimensions.

Aerogels that can suitably be used in embodiments may be divided into three major categories: inorganic aerogels, organic aerogels and carbon aerogels. In embodiments, the fuser member layer may contain one or more aerogels chosen from inorganic aerogels, organic aerogels, carbon aerogels and mixtures thereof. For example, embodiments can include multiple aerogels of the same type, such as combinations of two or more inorganic aerogels, combinations of two or more organic aerogels, or combinations of two or more carbon aerogels, or can include multiple aerogels of different types, such as one or more inorganic aerogels, one or more organic aerogels, and/or one or more carbon aerogels. For example, a chemically modified, hydrophobic silica aerogel may be combined with a high electrical conductivity carbon aerogel to simultaneously modify the hydrophobic and electrical properties of a composite and achieve a desired target level of each property.

Inorganic aerogels, such as silica aerogels, are generally formed by sol-gel polycondensation of metal oxides to form highly cross-linked, transparent hydrogels. These hydrogels are subjected to supercritical drying to form inorganic aerogels.

Organic aerogels are generally formed by sol-gel polycondensation of resorcinol and formaldehyde. These hydrogels are subjected to supercritical drying to form organic aerogels.

Carbon aerogels are generally formed by pyrolyzing organic aerogels in an inert atmosphere. Carbon aerogels are composed of covalently bonded, nanometer-sized particles that are arranged in a three-dimensional network. Carbon aerogels, unlike high surface area carbon powders, have oxygen-free surfaces, which can be chemically modified to increase their compatibility with polymer matrices. In addition, carbon aerogels are generally electrically conductive, having electrical resistivities of from about 0.005 to about 1.00 Ω-cm. In particular embodiments, the composite may contain one or more carbon aerogels and/or blends of one or more carbon aerogels with one or more inorganic and/or organic aerogels.

Carbon aerogels that may be included in embodiments exhibit two morphological types, polymeric and colloidal, which have distinct characteristics. The morphological type of a carbon aerogel depends on the details of the aerogel's preparation, but both types result from the kinetic aggregation of molecular clusters. That is, nanopores, primary particles of carbon aerogels that may be less than 20 Å (Angstroms) and that are composed of intertwined nanocrystalline graphitic ribbons, cluster to form secondary particles, or mesopores, which may be from about 20 to about 500 Å. These mesopores can form chains to create a porous carbon aerogel matrix. The carbon aerogel matrix may be dispersed, in embodiments, into polymeric matrices by, for example, suitable melt blending or solvent mixing techniques.

In embodiments, carbon aerogels may be combined with, coated, or doped with a metal to improve conductivity, magnetic susceptibility, and/or dispersibility. Metal-doped carbon aerogels may be used in embodiments alone or in blends with other carbon aerogels and/or inorganic or organic aerogels. Any suitable metal, or mixture of metals, metal oxides and alloys may be included in embodiments in which metal-doped carbon aerogels are used. In particular embodiments, and in specific embodiments, the carbon aerogels may be doped with one or more metals chosen from transition metals (as defined by the Periodic Table of the Elements) and aluminum, zinc, gallium, germanium, cadmium, indium, tin, mercury, thallium and lead. In particular embodiments, carbon aerogels are doped with copper, nickel, tin, lead, silver, gold, zinc, iron, chromium, manganese, tungsten, aluminum, platinum, palladium, and/or ruthenium. For example, in embodiments, copper-doped carbon aerogels, ruthenium-doped carbon aerogels and mixtures thereof may be included in the composite.

In embodiments, the aerogel components may have one or more particular properties or characteristics. For example, the aerogel components may comprise extremely fine particles, of less than about 500 Å; the aerogel components may have a low density; or the aerogel components may be surface activated, for example by protonation or acidification. Aerogel particles having one or a combination of these or other properties may be dispersed and/or bonded, in embodiments, into a polymer matrix to provide desirable effects, For example as noted earlier, in embodiments in which the aerogel components comprise nanometer-scale particles, these particles or portions thereof can occupy inter- and intramolecular spaces within the molecular lattice structure of the polymer, and thus can prevent water molecules from becoming incorporated into those molecular-scale spaces. Such blocking may decrease the hydrophilicity of the overall composite. In addition, many aerogels are hydrophobic. Incorporation of hydrophobic aerogel components may also decrease the hydrophilicity of the composites of embodiments. Composites having decreased hydrophilicity, and any components formed from such composites, have improved environmental stability, particularly under conditions of cycling between low and high humidity.

In addition, the porous aerogel particles may interpenetrate or intertwine with the polymer and thereby strengthen the polymeric lattice. The mechanical properties of the overall composite of embodiments in which aerogel particles have interpenetrated or interspersed with the polymeric lattice may thus be enhanced and stabilized.

For example, in one embodiment, the aerogel component can be a silica silicate having an average particle size of 5-15 μm, a porosity of 90% or more, a bulk density of 40-100 $kg/m^3$, and a surface area of 600-800 $m^2/g$. Of course, materials having one or properties outside of these ranges can be used, as desired.

Depending upon the properties of the aerogel components, the aerogel components can be used as is, or they can be chemically modified. For example, aerogel surface chemistries may be modified for various applications, for example, the aerogel surface may be modified by chemical substitution upon or within the molecular structure of the aerogel to have hydrophilic or hydrophobic properties. For example, chemical modification may be desired so as to improve the hydrophobicity of the aerogel components. When such chemical treatment is desired, any conventional chemical treatment well known in the art can be used. For example, such chemical treatments of aerogel powders can include replacing surface hydroxyl groups with organic or partially fluorinated organic groups, or the like.

In general, a wide range of aerogel components are known in the art and have been applied in a variety of uses. For example, many aerogel components, including ground hydrophobic aerogel particles, have been used as low cost additives in such formulations as hair, skincare, and antiperspirant compositions. One specific non-limiting example is the commercially available powder that has already been chemically treated, Dow Corning VM-2270 Aerogel fine particles having a size of about 5-15 microns.

In embodiments, the fuser member layer may comprise at least the above-described aerogel that is at least one of dispersed in or bonded to the polymer component. In particular embodiments, the aerogel is uniformly dispersed in and/or bonded to the polymer component, although non-uniform dispersion or bonding can be used in embodiments to achieve specific goals. For example, in embodiments, the aerogel can be non-uniformly dispersed or bonded in the polymer component to provide a high concentration of the aerogel in surface layers, substrate layers, different portions of a single layer, or the like.

Any suitable amount of the aerogel may be incorporated into the polymer component, to provide desired results. For example, the fuser member layer may be formed from about 0.2 to about 20 parts by weight aerogel per 100 parts by weight polymer component, such as from about 0.5 to about 15 parts by weight aerogel or from about 1 to about 10 parts by weight aerogel, per 100 parts by weight polymer component. To achieve a high level of hydrophobicity, the aerogel component should be combined with the polymer component so that the hydrophobic aerogel particles are included in a sufficient proportion to reduce contamination at the surface of the fuser member, which contamination could include toner components, paper additives, or the like. In particular embodiments, the aerogel component is provided in a minimum amount necessary to provide the desired results.

The fuser member outer layer coating solution may also contain a surfactant, if desired. Any suitable and known surfactant, or mixture of two or more surfactants, can be used. When present, the surfactant can be incorporated into the outer layer coating solution in any desired amount, such as to provide a coating solution that achieves defect-free or substantially defect-free coatings. In embodiments, the amount of surfactant included in the coating solution can be, for example, from about 0.01 or from about 0.1 to about 10 or to about 15% by weight, such as from about 0.5 to about 5% or to about 6% by weight of the coating solution.

If necessary or desired, a defoamer agent can also be used in the outer layer coating solution. For example, it has been found that some surfactants may cause foaming of the coating solution, although this is believed to be a mechanical phenomenon rather than evidence of a chemical reaction. Use of conventional defoaming agents, such as Chemie BYK-052, in known amounts can thus counteract the tendancy of foam formation.

Other adjuvants and fillers can be incorporated in the polymer of the outer surface layer in addition to the aerogel component, provided that they do not affect the integrity of the polymer material. Such fillers normally encountered in the compounding of elastomers include coloring agents, reinforcing fillers, processing aids, accelerators, and the like. Oxides, such as magnesium oxide, and hydroxides, such as calcium hydroxide, are suitable for use in curing many fluoroelastomers. Other metal oxides, such as cupric oxide, lead oxide and/or zinc oxide, can also be used to improve release. Metal oxides, such as copper oxide, aluminum oxide, magnesium oxide, tin oxide, titanium oxide, iron oxide, zinc oxide, manganese oxide, molybdenum oxide, and the like, carbon black, graphite, metal fibers and metal powder particles such as silver, nickel, aluminum, and the like, as well as mixtures thereof, can promote thermal conductivity. The addition of silicone particles to a fluoropolymer outer fusing layer can increase release of toner from the fuser member during and following the fusing process. Processability of a fluoropolymer outer fusing layer can be increased by increasing absorption of silicone oils, in particular by adding fillers such as fumed silica or clays such as organo-montmorillonites. Also suitable are reinforcing calcined alumina and non-reinforcing tabular alumina.

An inorganic particulate filler may also be used in addition to the aerogel component in connection with the fluoroelastomer outer layer. Such inorganic fillers have traditionally been used in order to provide anchoring sites for the functional groups of an applied silicone fuser agent. However, an additional filler may not be necessary for use with the present fuser member, or may be used in reduced amounts, as lower amounts of release agent may be used. Examples of suitable fillers include a metal-containing filler, such as a metal, metal alloy, metal oxide, metal salt or other metal compound. The general classes of metals which are applicable to the present invention include those metals of Groups 1b, 2a, 2b, 3a, 3b, 4a, 4b, 5a, 5b, 6b, 7b, 8 and the rare earth elements of the Periodic Table. The filler can be an oxide of aluminum, copper, tin, zinc, lead, iron, platinum, gold, silver, antimony, bismuth, zinc, iridium, ruthenium, tungsten, manganese, cadmium, mercury, vanadium, chromium, magnesium, nickel and alloys thereof. Other specific examples include inorganic particulate fillers are aluminum oxide and cupric oxide. Other examples include reinforcing and non-reinforcing calcined alumina and tabular alumina respectively.

The thickness of the outer fluoroelastomer surface layer of the fuser member herein is from about 10 to about 250 micrometers, such as from about 15 to about 100 micrometers.

Any suitable substrate can be selected for the fuser member. The fuser member substrate can be a roll, belt, flat surface, sheet, film, or other suitable shape used in the fixing of thermoplastic toner images to a suitable copy substrate. It can take the form of a fuser member, a pressure member, or a release agent donor member, for example in the form of a cylindrical roll. Typically, the fuser member is made of a hollow cylindrical metal core, such as copper, aluminum, stainless steel, or certain plastic materials chosen to maintain rigidity and structural integrity, as well as being capable of having a polymeric material coated thereon and adhered firmly thereto. It is desired in embodiments that the supporting substrate is a cylindrical sleeve, such as with an outer polymeric layer of from about 1 to about 6 millimeters. In one embodiments the core, which can be an aluminum or steel cylinder, is degreased with a solvent and cleaned with an abrasive cleaner prior to being primed with a primer, such as Dow Corning® 1200, which can be sprayed, brushed, or dipped, followed by air drying under ambient conditions for thirty minutes and then baked at 150° C. for 30 minutes.

Also suitable are quartz and glass substrates. The use of quartz or glass cores in fuser members allows for a lightweight, low cost fuser system member to be produced. Moreover, the glass and quartz help allow for quick warm-up, and are therefore energy efficient. In addition, because the core of the fuser member comprises glass or quartz, there is a real possibility that such fuser members can be recycled. Moreover, these cores allow for high thermal efficiency by providing superior insulation.

When the fuser member is a belt, the substrate can be of any desired or suitable material, including plastics, such as Ultem®, available from General Electric, Ultrapek®, available from BASF, PPS (polyphenylene sulfide) sold under the tradenames Fortron®, available from Hoechst Celanese, Ryton R-4®, available from Phillips Petroleum, and Supec®, available from General Electric; PAI (polyamide imide), sold under the tradename Torlon® 7130, available from Amoco; polyketone (PK), sold under the tradename Kadel® E1230, available from Amoco; PI (polyimide); polyaramide; PEEK (polyether ether ketone), sold under the tradename PEEK 450GL30, available from Victrex; polyphthalaminde sold under the tradename Amodel®D, available from Amoco; PES (polyethersulfone); PEI (polyetherimide); PAEK (polyaryletherketone); PBA (polyparabanic acid); silicone resin; and fluorinated resin, such as PTFE (polytetrafluoroethylene); PEA (perfluoroalkoxy); FEP (fluorinated ethylene propylene); liquid crystalline resin (Xydar®), available from Amoco; and the like, as well as mixtures thereof. These plastics can be filled with glass or other minerals to enhance their mechanical strength without changing their thermal properties. In embodiments, the plastic comprises a high temperature plastic with superior mechanical strength, such as polyphenylene sulfide, polyamide imide, polyimide, polyketone, polyphthalamide, polyether ether ketone, polyethersulfone, and polyetherimide. Suitable materials also include silicone rubbers. Examples of belt-configuration fuser members are disclosed in, for example, U.S. Pat. Nos. 5,487,707 and 5,514,436, the disclosures of each of which are totally incorporated herein by reference. A method for manufacturing reinforced seamless belts is disclosed in, for example, U.S. Pat. No. 5,409,557, the disclosure of which is totally incorporated herein by reference.

The optional intermediate layer can be of any suitable or desired material. For example, the optional intermediate layer can comprise a silicone rubber of a thickness sufficient to form a conformable layer. Suitable silicone rubbers include room temperature vulcanization (RTV) silicone rubbers, high temperature vulcanization (HTV) silicone rubbers, and (LSR) liquid silicone rubber. These rubbers are known and are readily available commercially such as SILASTIC® 735 black RTV and SILASTIC® 732 RTV, both available from Dow Corning, and 106 RTV Silicone Rubber and 90 RTV Silicone Rubber, both available from General Electric. Other suitable silicone materials include the silanes, siloxanes (such as polydimethylsiloxanes), such as fluorosilicones, dimethylsilicones, liquid silicone rubbers, such as vinyl crosslinked heat curable rubbers or silanol room temperature crosslinked materials, and the like. Other materials suitable for the intermediate layer include polyimides and fluoroelastomers, including those set forth below.

The optional intermediate layer typically has a thickness of from about 0.05 to about 10 millimeters, such as from about 0.1 to about 5 millimeters, or from about 1 to about 3 millimeters, although the thickness can be outside of these ranges. More specifically, if the intermediate layer is present on a pressure member, it typically has a thickness of from about 0.05 to about 5 millimeters, such as from about 0.1 to about 3 millimeters, or from about 0.5 to about 1 millimeter, although the thickness can be outside of these ranges. When present on a fuser member, the intermediate layer typically has a thickness of from about 1 to about 10 millimeters, such as from about 2 to about 5 millimeters, or from about 2.5 to about 3 millimeters, although the thickness can be outside of these ranges. In an embodiment, the thickness of the intermediate layer of the fuser member is higher than that of the pressure member, so that the fuser member is more deformable than the pressure member.

The polymer layers of the fuser member can be coated on the fuser member substrate by any desired or suitable means, including normal spraying, dipping, and tumble spraying techniques. A flow coating apparatus as described in U.S. Pat. No. 6,408,753, the disclosure of which is totally incorporated herein by reference, can also be used to flow coat a series of fuser rolls. It is desired in embodiments that the polymers be diluted with a solvent, prior to application to the fuser substrate. Alternative methods, however, can be used for coating layers, including methods described in U.S. Pat. No. 6,099,673, the disclosure of which is totally incorporated herein by reference.

Optional intermediate adhesive layers and/or intermediate polymer or elastomer layers may be applied to achieve desired properties and performance objectives of the present disclosure. The intermediate layer may be present between the substrate and the outer fluoroelastomer surface. An adhesive intermediate layer may be selected from, for example, epoxy resins and polysiloxanes. Examples of suitable intermediate layers include silicone rubbers such as room temperature vulcanization (RTV) silicone rubbers; high temperature vulcanization (HTV) silicone rubbers and liquid silicone rubber (LSR) silicone rubbers. These rubbers are known and readily is available commercially such as SILASTIC® 735 black RTV and SILASTIC® 732 RTV, both from Dow Corning; and 106 RTV Silicone Rubber and 90 RTV Silicone Rubber, both from General Electric. Other suitable silicone materials include the siloxanes (such as polydimethylsiloxanes); fluorosilicones such as Silicone Rubber 552, available from Sampson Coatings, Richmond, Va.; liquid silicone rubbers such as vinyl crosslinked heat curable rubbers or silanol room temperature crosslinked materials; and the like. Another specific example is Dow Corning Sylgard 182.

There may be provided an adhesive layer between the substrate and the intermediate layer. There may also be an adhesive layer between the intermediate layer and the outer layer. In the absence of an intermediate layer, the fluoroelastomer layer may be bonded to the substrate via an adhesive layer.

The thickness of the intermediate layer is from about 0.5 to about 20 mm, or from about 1 to about 5 mm. In embodiments where the intermediate layer is an adhesive layer, the adhesive layer thickness can be, for example, about 5 to about 20 microns.

An example is set forth hereinbelow and is illustrative of different compositions and conditions that can be utilized in practicing the disclosure. All proportions are by weight unless otherwise indicated. It will be apparent, however, that the disclosure can be practiced with many types of compositions and can have many different uses in accordance with the disclosure above and as pointed out hereinafter.

EXAMPLES

Comparative Example 1

A conventional fuser member is prepared as follows. A fuser member coating formulation was prepared from a solvent solution/dispersion containing 100 parts by weight of a hydrofluoroelastomer, DuPont Viton® GF, a tetrapolymer of 35 weight percent vinylidenefluoride, 34 weight percent hexafluoropropylene, 29 weight percent tetrafluoroethylene, and 2 weight percent of a cure site monomer. The Viton® GF was mixed with 5 parts by weight of AO700 curative (N-(2-aminoethyl)-3-aminopropyltrimethoxysilane, available from United Chemical Technologies, Inc.), in methyl isobutylketone (MIBK). The coating composition was dispensed onto a fuser roll surface via flow coating to a nominal thickness of about 20 micrometers. The coating was cured by stepwise heating in air at 95° C. for 2 hours, 175° C. for 2 hours, 205° C. for 2 hours, and 230° C. for 16 hours, to produce a layer of about 20 microns in thickness.

Example 1

A fuser member is prepared as in Comparative Example 1, except that the 3 parts by weight silica silicate VM2270 aerogel powder, obtained from Dow Corning, was further added to the coating composition. VM2270 aerogel powder contains 5-15 micron particles having >90% porosity, 40-100 kg/m$^3$ bulk density, and 600-800 m$^2$/g surface area.

Example 2

A fuser member is prepared as in Comparative Example 1, except that the 5 parts by weight silica silicate VM2270 aerogel powder, obtained from Dow Corning, was further added to the coating composition.

Example 3

A fuser member is prepared as in Comparative Example 1, except that the 10 parts by weight silica silicate VM2270 aerogel powder, obtained from Dow Corning, was further added to the coating composition.

Testing of Examples and Comparative Example

The prepared dispersions of Comparative Example 1 and Examples 1 and 2 were observed to thicken with increased loading of aerogel, but still produced smooth coatings at 3 and 10 pph aerogel loadings. All test coatings prepared were heat treated between 49° C. and 218° C. according to the standard conditions described above.

Extractable measurements were performed as an indication of crosslinking efficiency, using cold methyl ethyl ketone (MEK) extraction for 24 hours. Samples of Comparative Example 1 and Example 2 were tested. Result given below indicate that the addition of aerogel particles does not interfere with crosslinking using AO700 crosslinker. Both values are within acceptable limits.

TABLE 1

Extractables Results

| Sample | % Weight Extracted by MEK |
|---|---|
| Comp. Ex. 1 | 3.53 |
| Example 3 | 2.47 |

Mechanical testing was carried out on thick 100-200 micron films with an Intron 3367 in a 70° F., 50% relative humidity atmosphere using 50 N load cell. Table 2 shows that at 3 pph loading, there is an improvement in both tensile stress and strain, while the modulus is not significantly different from the control, indicating that the material is not becoming too stiff (which would be undesirable). The greatest improvement is in toughness, which is almost 50% higher for the 3 pph sample and is expected to yield an improvement in fuser wear. The composite with 10 pph aerogel loading displays low tensile strain and high modulus, indicating that the loading of powder is too high, and results in a harder, stiff material.

TABLE 2

Mechanical Properties

| Sample | Tensile Stress (psi) | Tensile Strain (%) | Modulus (psi) | Toughness (in * lb$_f$/in$^3$) |
|---|---|---|---|---|
| Comp. Ex. 1 | 1130.2 | 176.2 | 985.0 | 837.9 |
| Example 1 | 1263.7 | 200.7 | 849.2 | 1163.3 |
| Example 3 | 1647.3 | 91.3 | 4138.8 | 908.2 |

Surface energies of films were measured on heat-treated composite coatings of approximately 20 micron thickness. Surface free energies calculated are based on contact angles from water, formamide, and diiodomethane. In contrast to some other hard ceramic fillers, the addition of the aerogel powder does not increase the surface energy, and are in fact decreasing the surface energy from that of Viton/AO700. Testing compatibility with fuser oil would also be beneficial.

TABLE 3

| Surface Energy ($mN/m^2$) | | | |
|---|---|---|---|
| Sample | SFE - 0.1 s | SFE - 1 s | SFE - 10 s |
| Comp. Ex. 1 | 25.32 | 25.59 | 25.83 |
| Example 1 | 24.46 | 24.07 | 24.15 |
| Example 2 | 19.95 | 20.05 | 20.25 |
| Example 3 | 22.00 | 21.31 | 24.15 |

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A fuser member comprising:

a substrate; and an outer layer comprising a polymeric material and an aerogel component that is at least one of dispersed in or bonded to the polymeric material, wherein the aerogel component comprises aerogel particles having a surface area of from about 400 to about 1200 $m^2/g$.

2. The fuser according to claim 1, wherein the aerogel component is selected from the group consisting of inorganic aerogels, organic aerogels, carbon aerogels, and mixtures thereof.

3. The fuser according to claim 1, wherein the aerogel component is a silica aerogel.

4. The fuser according to claim 1, wherein the aerogel component is hydrophobic.

5. The fuser according to claim 1, wherein the aerogel component comprises aerogel particles having a porosity greater than or equal to about 50%.

6. The fuser according to claim 1, wherein the aerogel component is dispersed in and not chemically bonded to the polymeric material.

7. The fuser according to claim 1, wherein the aerogel component is chemically bonded to the polymeric material.

8. The fuser according to claim 1, comprising a mixture of two or more different aerogel components.

9. The fuser according to claim 1, wherein the aerogel component is uniformly dispersed in the polymeric material.

10. The fuser according to claim 1, wherein the aerogel component is present in an amount of from about 0.2 to about 20 parts by weight per 100 parts by weight polymeric material.

11. The fuser according to claim 1, wherein the outer layer further comprises a defoamer agent.

12. The fuser according to claim 1, wherein said polymeric material is a fluoroelastomer selected from the group consisting of a) copolymers of two of vinylidene fluoride, hexafluoropropylene and tetrafluoroethylene; b) terpolymers of vinylidene fluoride, hexafluoropropylene and tetrafluoroethylene; and c) tetrapolymers of vinylidene fluoride, hexafluoropropylene, tetrafluoroethylene, and a cure site monomer.

13. The fuser according to claim 12, wherein the fluoroelastomer is a tetrapolymer of vinylidene fluoride, hexafluoropropylene, tetrafluoroethylene, and a cure site monomer.

14. The fuser according to claim 12, wherein the fluoroelastomer comprises about 35 weight percent of vinylidenefluoride, about 34 weight percent of hexafluoropropylene, about 29 weight percent of tetrafluoroethylene, and about 2 weight percent cure site monomer.

15. The fuser according to claim 1, further comprising an intermediate layer positioned between the substrate and the outer layer.

16. The fuser according to claim 15, wherein the intermediate layer comprises silicone rubber.

17. An image forming apparatus for forming images on a recording medium comprising:

a charge-retentive surface to receive an electrostatic latent image thereon;

a development component to apply a developer material to the charge-retentive surface to develop the electrostatic latent image to form a developed image on the charge retentive surface;

a transfer component to transfer the developed image from the charge retentive surface to a copy substrate; and a fuser member component to fuse the transferred developed image to the copy substrate, wherein the fuser member comprises:

a substrate; and an outer layer comprising a polymeric material and an aerogel component that is at least one of dispersed in or bonded to the polymeric material, wherein the aerogel component comprises aerogel particles having a surface area of from about 400 to about 1200 m2//g.

18. A method of making a fuser member, comprising:

applying an outer layer comprising a polymeric material and an aerogel component over a substrate, wherein the aerogel component comprises aerogel particles having a surface area of from about 400 to about 1200 $m^2/g$, and curing the outer layer such that the aerogel component is at least one of dispersed in or bonded to the polymeric material.

19. The method of claim 18, wherein the applying comprises:

reacting a fluoroelastomer, a crosslinking agent, a polar solvent, and the aerogel component to form a coating solution, and providing the coating solution on the substrate to form a fuser member coating.

* * * * *